US010189179B2

(12) United States Patent
Schlüsselbauer et al.

(10) Patent No.: US 10,189,179 B2
(45) Date of Patent: Jan. 29, 2019

(54) SYSTEM AND METHOD FOR PRODUCING TUBULAR CONCRETE PRODUCTS

(71) Applicant: Johann Schlüsselbauer, Altenhof (AT)

(72) Inventors: Johann Schlüsselbauer, Altenhof (AT); Ulrich Schlüsselbauer, Altenhof (AT)

( * ) Notice: Subject to any disclaimer, the term of this patent is extended or adjusted under 35 U.S.C. 154(b) by 584 days.

(21) Appl. No.: 14/431,154

(22) PCT Filed: Sep. 3, 2013

(86) PCT No.: PCT/EP2013/068149
§ 371 (c)(1),
(2) Date: Mar. 25, 2015

(87) PCT Pub. No.: WO2014/048684
PCT Pub. Date: Apr. 3, 2014

(65) Prior Publication Data

US 2015/0246460 A1 Sep. 3, 2015

(30) Foreign Application Priority Data

Sep. 25, 2012 (DE) ..... 10 2012 217 324

(51) Int. Cl.
*B28B 15/00* (2006.01)
*B28B 17/00* (2006.01)
*B28B 21/04* (2006.01)

(52) U.S. Cl.
CPC ..... *B28B 15/007* (2013.01); *B28B 15/00* (2013.01); *B28B 17/0063* (2013.01); *B28B 21/04* (2013.01)

(58) Field of Classification Search
CPC combination set(s) only.
See application file for complete search history.

(56) References Cited

FOREIGN PATENT DOCUMENTS

FR 2 889 817 A1 2/2007

OTHER PUBLICATIONS

Modernprecast titled "Schlusselbauer and Modern Precast Concrete's RCP Manufacturing Process" https://www.youtube.com/watch?v=eEQxbRzts6Y.*
Jan. 9, 2014 International Search Report Issued International Application No. PCT/EP2013/068149 (with English Translation).

* cited by examiner

*Primary Examiner* — Yogendra N Gupta
*Assistant Examiner* — Ninh Le
(74) *Attorney, Agent, or Firm* — Eversheds Sutherland (US) LLP

(57) ABSTRACT

A method and system for producing tubular concrete products in a casting method using upright casting molds. The system includes a fabrication zone with a plurality of fully automated fabrication stations and a mold conveyor, the first zone having: a first demolding station for removing an outer mold from a casting mold positioned at the first demolding station, a second demolding station for removing a cured tubular concrete product form a mold core positioned at the second demolding station, a mold core cleaning station for cleaning a mold core positioned at the mold core cleaning station, an outer mold cleaning station for cleaning an outer mold positioned at the outer mold cleaning station, a mold assembly station for assembling a casting mold from an outer mold and a mold core, and at least one filling station for filling an assembled casting mold with concrete.

15 Claims, 10 Drawing Sheets

SYSTEM AND METHOD FOR PRODUCING TUBULAR CONCRETE PRODUCTS

CROSS REFERENCE TO RELATED APPLICATIONS

The present application is a national stage of PCT/EP2013/068149, filed on Sep. 3, 2013 and published as WO 2014/048684, which claims priority to German Patent Application No. 10 2012 217 324.2, filed on Sep. 25, 2012.

The present invention relates to a system and method for producing tubular concrete products, in particular concrete tubes, in a casting method by means of upright casting molds, wherein the casting molds each have an upright outer mold and a mold core arranged in the upright outer mold.

BACKGROUND OF THE INVENTION

The prior art discloses partly automated plants and systems for producing tubular concrete products, in particular concrete tubes, in which tubular concrete products are produced. The partly automated production of tubular concrete products is here usually conducted by means of the vibration press method using vibration compaction devices or by means of the rotary press method where the compaction and inner shaping of the tubular concrete products is carried out using a roll head. However, the production systems for producing tubular concrete products by means of the vibration press method or the rotary press method are expensive and require a large set-up area since necessary and bulky vibration compaction devices or rotary press devices have to be provided and in addition a large product store and a large space requirement for additionally necessary sleeve and mold stores are necessary. In addition, complex refitting processes are required when products having different dimensions shall be produced.

Furthermore, it is known to produce individual tubular concrete products in high quality in a casting method in a place-bound upright formwork. However, on account of the longer required curing times of the concrete it is significantly more difficult to provide an automated production system where tubular concrete products can be produced in automated fashion by the cost-effective casting method of high quality.

It is an object of the present invention to provide a system and a method where tubular concrete products can be produced at lower costs and with high quality and reliability in automated and efficient fashion in a casting method.

In particular, it is an object of the present invention to provide a system and a method in which tubular concrete products of different sizes and shapes or dimensions can be produced with short lengths of cycle and/or cycle times, the lowest possible assembly times and in particular short downtimes in automated and efficient fashion in a casting method.

SUMMARY OF THE INVENTION

With respect to the above mentioned objects of the present invention, the present invention proposes a system for producing tubular concrete products, in particular concrete tubes, in a casting method by means of upright casting molds and a method for producing tubular concrete products, in particular concrete tubes, in a casting method by means of upright casting molds. Dependent claims relate to preferred exemplary embodiments of the present invention.

A first aspect of the present invention proposes a system for producing tubular concrete products in a casting method by means of upright casting molds, wherein the casting molds each have an upright outer mold and a mold core arranged in the upright outer mold.

According to the invention, the system comprises a fabrication zone having a plurality of fully automated fabrication stations and a mold conveyor for conveying the casting molds or the outer mold and the mold core of casting molds between the fabrication stations.

The fabrication zone has at least one demolding station for removing an outer mold from a casting mold positioned at the demolding station and for removing a cured tubular concrete product from a mold core positioned at the demolding station, at least one cleaning station for cleaning a mold core positioned at the cleaning station and for cleaning an outer mold positioned at the at least one cleaning station, at least one mold assembly station for assembling a casting mold from an outer mold and a mold core and at least one filling station for filling an assembled casting mold with concrete.

The present invention is able to provide an advantageous and useful production system for producing tubular concrete products in a casting method by means of upright casting molds, wherein, after the curing of the concrete, filled casting molds are positioned at the mold feeding position to release the finished cured concrete products in fully automated fashion via the at least one demolding station at the product releasing position, wherein the outer mold and the mold core of the casting mold just demolded at the at least one demolding station can be conveyed directly afterwards to at least one cleaning station by means of the mold conveyor to be assembled directly afterwards or optionally after travelling further optional fabrication stations at the mold assembly station into a casting mold that can be immediately used again and then be supplied to a filling station directly afterwards and in the filled state be released for the purpose of curing at the mold releasing position.

It is here advantageously possible to have short lengths of cycle or cycle times at the mold releasing position between the positioning of a cured filled casting mold at the mold feeding position and the release of the same casting mold which is filled for curing a new concrete product, in particular due to the path-optimized arrangement of fabrication stations where each casting mold undergoes a path-optimized circulation cycle comprising demolding after curing, cleaning, assembling, casting and then curing again.

Complex and costly vibration compaction devices or roll press devices are not necessary in the production cycle so as to considerably reduce the energy requirement of the manufacturing plant and in addition create improved working conditions at the plant on account of the lacking noise exposure.

Another cost advantage follows additionally from the fact that, in contrast to formwork used vibration press methods and roll press methods, the casting molds used in a casting method are exposed to a significantly lower mechanical load, and therefore the maintenance costs can considerably be reduced.

Furthermore, concrete products of high quality can be produced efficiently and in fully automated fashion by means of the casting method. In particular, an improved compaction of the concrete can be achieved by the casting method, wherein the finished concrete products have a reduced tendency to crack and a higher stability.

In addition, compared to plants which operate on the basis of the vibration press method or the roll press method it is possible to further increase the product diversity and/or save material in the production since the casting method enables thinner wall thicknesses of the finished tubular concrete products. Furthermore, the casting method advantageously enables less limited shaping during the manufacture of the concrete products. Finally, it is advantageously possible to arrange the system on a small set-up area which does not require a foundation or basement.

According to a preferred aspect, the mold conveyor can be adapted to convey a filled casting mold from a mold feeding position to the at least one demolding station, to convey an outer mold removed at the at least one demolding station to the at least one cleaning station, to convey a cured tubular concrete product removed at the at least one demolding station to a product release position, to convey a mold core from the at least one demolding station to the at least one cleaning station, to convey a mold core from the at least one cleaning station to the at least one mold assembly station, to convey an outer mold from the at least one cleaning station to the at least one mold assembly station, to convey a casting mold assembled at the at least one mold assembly station to the at least one filling station and/or to convey a casting mold filled with concrete at the at least one filling station to a mold releasing position.

According to a preferred aspect, the system can comprise a first demolding station for removing an outer mold from a casting mold positioned at the first demolding station and a second demolding station for removing a cured tubular concrete product from a mold core positioned at the second demolding station. The mold conveyor is then preferably adapted to convey a mold core with a cured tubular concrete product from the first demolding station to the second demolding station.

According to a preferred aspect, the system can comprise a mold core cleaning station for cleaning a mold core positioned at the mold core cleaning station and an outer mold cleaning station for cleaning an outer mold positioned at the outer mold cleaning station, wherein the mold conveyor is adapted to convey a mold core from the mold core cleaning station to the mold assembly station and to convey an outer mold from the outer mold cleaning station to the mold assembly station.

The mold conveyor is preferably adapted to convey a mold core from the second demolding station to the mold core cleaning station and to convey an outer mold from the first demolding station to the outer mold cleaning station.

According to the above preferred aspects, fabrication stations arranged in parallel or sequentially can be provided to optionally demold mold cores and outer molds at separate stations (e.g. by means of first and second demolding stations arranged in parallel or sequentially) and/or clean them at separate stations (e.g. by means of mold core and outer mold cleaning stations arranged in parallel or sequentially). This enables to coordinate in optimum fashion the production of the concrete products by suitable sequential or parallel travelling through the fabrication stations to further advantageously reduce the lengths of cycle and cycle times.

According to a preferred aspect of the present invention, the system also comprises a curing zone for storing a plurality of filled casting molds and/or a transport device for transporting casting molds from the mold releasing position to the curing zone and from the curing zone to the mold feeding position.

The advantage is that along with the fabrication zone with the fully automated fabrication stations a zone is created where filled casting molds can be stored for curing after being filled at the filling station or before demolding the cured concrete product at the demolding stations in the production cycle and can be transported from the transport device between the storage position in the curing zone and the mold releasing position or the mold feeding position of the fabrication zone.

Here, the casting molds are preferably stored in an upright position in the curing zone, and therefore all production steps can be traveled with an upright or vertically oriented casting mold. In this connection, it is advantageous that no further step is required in which casting molds have to be turned or rotated in the circulation cycle.

According to an advantageous preferred embodiment, the casting molds stored in the curing zone are divided into a plurality of groups of casting molds, wherein casting molds of one group preferably have an equal mold size and casting molds of different groups preferably have different mold sizes. According to this aspect, it is preferred to store casting molds of different sizes, i.e. different dimensions, in the curing zone.

According to the above described, preferred embodiment, it is possible in a particularly advantageous manner to simultaneously use casting molds of different mold sizes in the circulation cycle, and therefore concrete products of different sizes or dimensions can advantageously be produced in the system with extremely short assembly times or even without any assembly time and in particular without any downtime.

Different mold sizes can here distinguish themselves by different lengths of the casting molds in a vertical direction and/or by different widths or diameters. The casting molds stored in the curing zone preferably have different widths or diameters, wherein at least all the casting molds of a certain width or a certain diameter are preferably equal since the length of the concrete products can already be controlled by the filling height of the concrete in the casting molds by filling casting molds in full or only in part when the intended length of the produced concrete product is reduced, and therefore concrete products of different lengths can be produced by means of casting molds having one mold size.

According to an advantageous preferred embodiment, the curing zone has a plurality of connected subzones, wherein the casting molds stored in the curing zone are preferably arranged in groups and casting molds of one group are preferably arranged in a connected common subzone of the curing zone. The advantage is that casting molds can be stored in the curing zone in such a way that they are arranged according to the mold size. However, exemplary embodiments are additionally conceivable which have a mixed storage arrangement where casting molds of different mold sizes are stored next to one another and e.g. in a nested arrangement, e.g. in a storage area-optimizing or holding area-optimized arrangement. Furthermore, it is possible to select a cycle-optimized storing arrangement where the arrangement of the casting molds is carried out in such a way that it is path-optimized for the transport device.

According to a preferred aspect of the present invention, the mold conveyor comprises a first mold conveying section and a second mold conveying section which extends parallel to the first mold conveying section. The feature of the "parallel arrangement" should here be comprehended in a production-technical way, such that fabrication stations arranged along the first mold conveying section can be traveled through in parallel with respect to fabrication stations arranged along the second mold conveying section.

Here, the first mold conveying section is preferably in particular adapted to convey a mold core from the second demolding station to the mold core cleaning station and to convey a mold core from the mold core cleaning station to the mold assembly station, and the second mold conveying section is preferably in particular adapted to convey an outer mold removed at the first demolding station to the outer mold cleaning station and to convey an outer mold from the outer mold cleaning station to the mold assembly station.

The advantage is that the mold core of a casting mold can be guided separately between the demolding stations and the assembly station and parallel to the outer mold of the same casting mold as regards the production-technology, before the mold core and the outer mold are assembled again into a casting mold at the assembly station.

Special operating steps can here be made advantageously in a time-efficient and parallelized fashion. In particular, it is advantageous for the cleaning of the casting mold to be parallelized in a production-technical fashion and to be carried out substantially at the same time for the outer mold and the mold core while being separate from one another at separate cleaning stations. This enables another significant reduction in the lengths of cycle or cycle times without having a possible negative effect on the quality of the concrete products.

According to an advantageous preferred embodiment, the first mold conveying section is preferably adapted to convey a mold core in a first plane from the second demolding station to the mold assembly station, and the second mold conveying station is preferably adapted to convey an outer mold in a second plane from the first demolding station to the mold assembly station, wherein the second plane is arranged above the first plane.

The advantage is that the outer mold can be pulled upwards at the first demolding station by an upright casting mold arranged in the first, lower plane to the upper, second plane to then be conveyed without another lowering or turning at the height of the second plane by means of the second mold conveying section from the position of the first demolding station to the position of the assembly station where the outer mold, which is lowered to the first plane, can be placed on a mold core arranged at the assembly station at the height of the first plane to assemble the casting mold. The mold core, however, can advantageously be conveyed without any turning, lowering or lifting being required directly at the height of the first plane by means of the first mold conveying section in an upright fashion from the second demolding station to the assembly station.

Another advantage of this exemplary embodiment is that the outer molds can be cleaned from below and/or that further post-processes, such as oiling of the outer mold, can be carried out from below. Possible dirt during cleaning or oil in the post-processing step can simply drop or flow down downwards or can otherwise be removed downwards in a simple way.

According to another advantageous preferred embodiment, the mold conveyor is adapted to convey a filled casting mold in the first plane from the mold feeding position to the first demolding station, to convey a mold core with a cured tubular concrete product in the first plane from the first demolding station to the second demolding station, to convey a cured tubular concrete product removed at the second demolding station in the first plane to the product output position, to convey a casting mold assembled at the mold assembly station in the first plane to the filling station and to convey a casting mold filled with concrete at the filling station in the first plane to the mold releasing position.

The advantage is that in the entire circulation cycle the casting mold can be conveyed from the mold feeding position to the demolding stations, the mold core can be conveyed between the demolding stations and the assembly station and the reassembled casting mold can be conveyed between the assembly station and the mold releasing position in a path-optimum fashion and without turning, lowering or lifting being required directly at the height of the first plane by means of the mold conveyor, wherein only the outer mold travels a separate production path between the demolding stations and the assembly station.

According to a preferred aspect of the present invention, the fabrication zone has a first filling station for filling an assembled casting mold with concrete and a second filling station for filling an assembled casting mold with concrete, wherein the conveyer is preferably adapted to convey a casting mold assembled to the mold assembly station to the first filling station or to the second filling station. Preferably, the conveyor is further adapted to convey a casting mold filled with concrete at the first filling station to a first mold releasing position and to convey a casting mold filled with concrete at the second filling station to a second mold releasing position.

The advantage is that the lengths of cycle or cycle times of the circulation system can still be further reduced considerably since the production step of the time-consuming filling of the casting mold with concrete can be parallelized at the filling station or the filling stations in such a way that the first filling station releases a first casting mold to the mold releasing position and receives another second casting mold from the assembly station while the second filling station already fills a third casting mold and vice versa. It is thus possible to reduce the lengths of cycle, in particular since the minimum length of cycle of the entire system is not given by the minimum length of cycle of the filling station but can be cut into half compared to the minimum length of cycle of the filling station.

According to other preferred exemplary embodiments, in particular for producing concrete products with predominantly large mold size and increased lengths of cycle of the filling station resulting therefrom, a plurality of filling stations can furthermore be provided, wherein the conveyor is preferably adapted to convey the casting mold assembled at the assembly station to each of the plurality of filling stations, and to preferably convey in particular the casting molds assembled at the assembly station successively to changing filling stations.

According to a preferred aspect of the present invention, the system comprises a control device for controlling the fully automated fabrication stations and the mold conveyor. Furthermore, the control device is preferably adapted to control the transport device.

The advantage is that all fabrication stations and the mold conveyor can be controlled by means of a common control device in coordinate fashion and in conformity with one another. Here, the control device is preferably adapted to control the fabrication stations in such a way that the operations are simultaneously executed at the fabrication stations and to preferably control the conveyor in such a way that depending on a length of cycle casting molds, outer molds and/or mold cores are conveyed to the respectively next fabrication stations of the circulation cycle after carrying out the respective operations at the fabrication stations.

According to an advantageous preferred embodiment, the control device is adapted to control a concrete volume to be filled in while filling the casting mold arranged on the at least one filling station depending on a predetermined concrete product length. Here, it is advantageously not necessary to provide casting molds of different length in a vertical direction for the production of concrete products having different length since the length of the concrete products can be adjusted by the controlled filling height.

According to another advantageous preferred embodiment, the control device comprises a memory unit for storing production data which indicate for all casting molds stored in the curing zone a respective storage position and a respective curing time.

Thus, the transport device can advantageously be controlled depending on the data stored in the memory unit, e.g. by receiving, after a predetermined curing period, a casting mold having a cured concrete product by means of the transport device at the storage position indicated in the data in order to be transported to the mold feeding position and, preferably after travelling the fabrication stations, to be transported for the purpose of curing from the mold releasing position to the storage position of this casting mold, which is indicated in the data and is still unoccupied.

Alternatively it is also possible to deposit data in the memory means after receiving a casting mold to the effect that the corresponding storing position is cleared, wherein filled casting molds are transported from the mold releasing position to storage positions which are indicated as unoccupied in the data. Furthermore, the memory unit can store a filling time for each casting mold to determine the curing time by means of the filling time to determine whether a concrete product is cured and can be supplied with the casting mold to the mold feeding position again.

The system preferably comprises at least one coating station for coating a cleaned outer mold and/or for coating a cleaned mold core between one or more cleaning stations and the at least one mold assembly station, e.g. by means of a separating agent, e.g. wax or oil.

According to another aspect, the present invention proposes a method for producing tubular concrete products in a casting method by means of upright casting molds, wherein the casting molds each have an upright outer mold and a mold core arranged in the upright outer mold, in a system according to one of the preceding aspects and preferred embodiments.

The method comprises the operating steps of removing an outer mold from a casting mold positioned at the at least one demolding station, removing a cured tubular concrete product from a mold core positioned at the at least one demolding station, cleaning a mold core positioned at the at least one cleaning station, cleaning an outer mold positioned at the at least one cleaning station, assembling a casting mold from an outer mold and a mold core at the mold assembly station and filling an assembled casting mold with concrete at the at least one filling station.

Furthermore, the method preferably comprises the conveying steps, carried out by means of the mold conveyor, of conveying the casting molds or the outer mold and the mold core of casting molds between the fabrication stations of the system.

Here, the conveying steps are preferably carried out from a fabrication station to the next fabrication station or to an intermediate position between two fabrication stations at the same time, wherein in addition to the above mentioned fabrication stations further optional fabrication stations can be added to the system, wherein the conveying steps mentioned above concretely can then be divided in a plurality of conveying steps which, in turn, are separated from one another by an optional operating step at an optional fabrication station.

In general, it is preferred for a reduction in the cycle times when in each case a plurality or all operation steps are carried out at the same time and then a plurality or all conveying steps are carried out at the same time and then again a plurality or all operation steps are carried out at the same time, etc. In this case, a cycle or the length of cycle corresponds substantially to the sequential conduction of the operating steps once in each case and the conveying steps once in each case. A cycle time corresponds substantially to the sequence of the lengths of cycle which are necessary to convey a special casting mold in the circulation system from the mold feeding position by several repetitions of the sequential conduction of the operating steps once in each case and the conveying steps to the mold releasing position once in each case.

Here, it is advantageously conceivable to provide one or more of the fabrication stations in sequential and/or parallel fashion twice or even several times to be able to further optimize lengths of cycle and/or cycle times. As regards special products, e.g. especially large products or especially complex products or products which have to be assembled in a special way (e.g. jacking pipes, etc.), additional fabrication stations can be provided sequentially or preferably in parallel (e.g. also by bypassing other regular fabrication stations), including optional manual machining stations where the special product to be manually machined can be taken temporarily from the fully automatic circulation cycle.

For example, the method according to the invention preferably comprises the operating steps of removing an outer mold from a casting mold positioned at the first demolding station, removing a cured tubular concrete product from a mold core positioned at the second demolding station, cleaning a mold core positioned at the mold core cleaning station, cleaning an outer mold positioned at the outer mold cleaning station, assembling a casting mold from an outer mold and a mold core at the mold assembly station and filling an assembled casting mold with concrete at the at least one filling station. These operating steps are preferably carried out at the same time.

According to a preferred aspect of the present invention, the method also comprises the conveying steps, carried out by means of the mold conveyor, of conveying a filled casting mold from a mold feeding position to the first demolding station, conveying an outer mold removed at the first demolding station to the outer mold cleaning station, conveying a mold core with cured tubular concrete product from the first demolding station to the second demolding station, conveying a cured tubular concrete product removed at the second demolding station to the product release station, conveying a mold core from the second demolding station to the mold core cleaning station, conveying a mold core from the mold core cleaning station to the mold assembly station, conveying an outer mold from the outer mold cleaning station to the mold assembly station, conveying a casting mold assembled at the mold assembly station to the at least one filling station and conveying a casting mold filled with concrete at the at least one filling station to the mold releasing position.

In summary, the present invention makes it possible to provide a system and a method in which tubular concrete products can be produced at lower costs and with high quality and reliability in automated and efficient fashion in a casting method, and to provide in particular a system and a method in which tubular concrete products having different dimensions can be produced with short lengths of cycle, with extremely short or even without disadvantageous assembly times and in particular short downtimes in automated and efficient fashion in a casting method.

DETAILED DESCRIPTION OF THE DRAWINGS AND PREFERRED EXEMPLARY EMBODIMENTS OF THE INVENTION

In the following, preferred exemplary embodiments of the present invention are described in detail below with reference to the enclosed figures. However, the present invention is not limited to the described exemplary embodiments. The present invention is defined by the scope of the claims. Equal or similar features of the exemplary embodiments are marked in the figures by the same reference signs. In so far as differences are not indicated explicitly or are evident from the figures, it has to be assumed that the description of the features with equal reference signs as a reference to an exemplary embodiment also applies to another exemplary embodiment, wherein the description is not indicated several times on account of a concise description.

Furthermore, the exemplary embodiments should not be regarded as limiting with respect to themselves since it is possible to combine features of the below described exemplary embodiments of the present invention or to modify exemplary embodiments by features of other exemplary embodiments to obtain further exemplary embodiments of the present invention. In so far as such modifications or combinations of features come under the scope of the claims, they are to be regarded as part of the invention and in so far as they are evident to a person skilled in the art, such modifications and/or combinations of features should also be considered to be implicit as part of the disclosure of this description.

First Exemplary Embodiment

Figure 1:
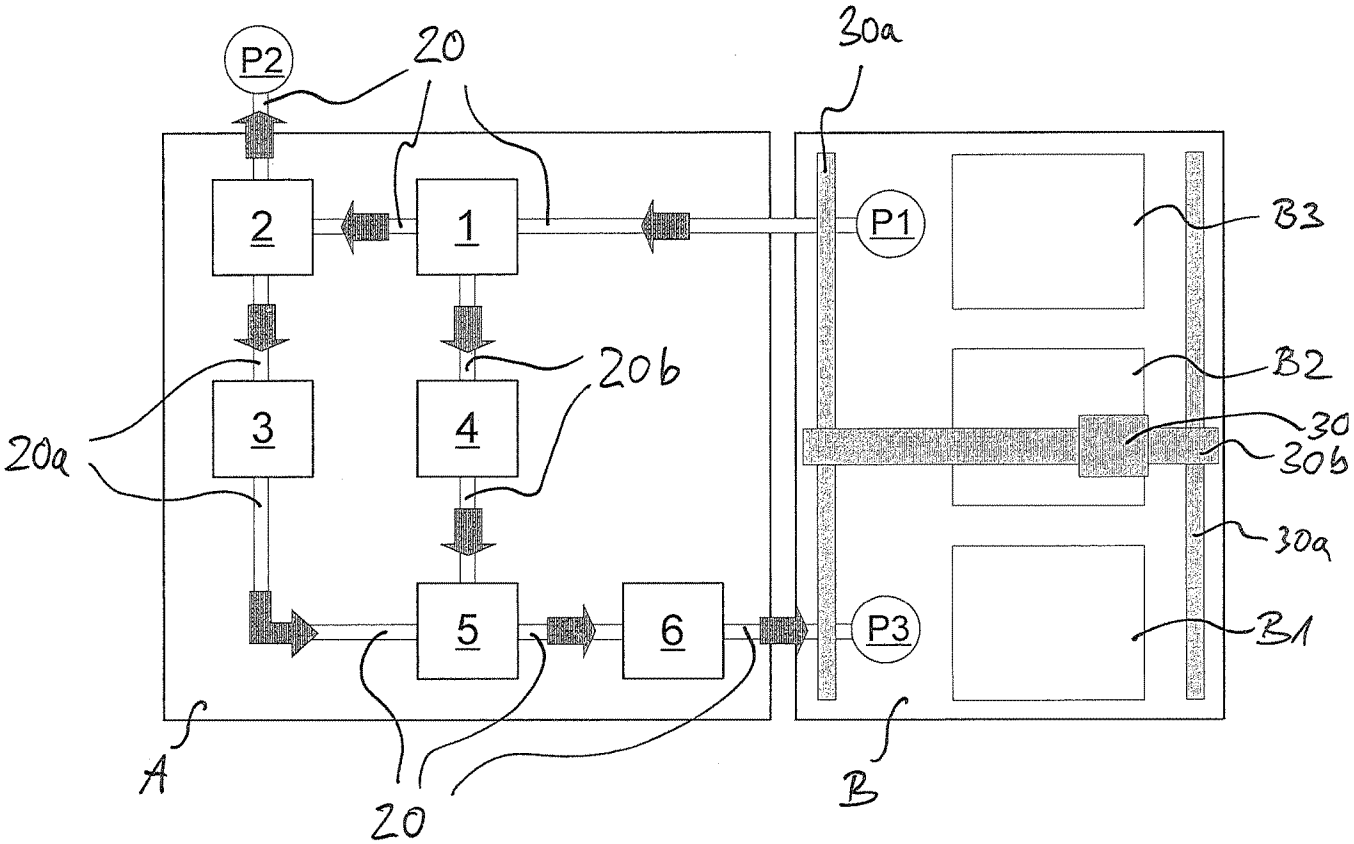
FIG. 1 shows a schematic top view of a system for producing tubular concrete products in a casting method by means of upright casting molds according to a first exemplary embodiment of the invention.

FIG. 1 shows a schematic top view of a system for producing tubular concrete products in a casting method by means of upright casting molds according to a first exemplary embodiment of the invention.

In general, all casting molds used in the system have an upright outer mold and a mold core vertically arranged in the upright outer mold. Optionally, the casting molds have at the bottom side a base sleeve which serves as a base for positioning the casting molds and also for locking the outer mold with the mold core. Such base sleeves can be removed or be fixedly mounted on the mold core.

The system for producing tubular concrete products in a casting method comprises a fabrication zone A having a plurality of fully automated fabrication stations 1 to 6 and a mold conveyor 20 with the mold conveying sections 20*a* and 20*b*, which for respective production lines which are carried out in parallel with respect to production technology extend between the fabrication stations 1 and 5, once via the fabrication station 3 and once via the fabrication station 4. The fabrication stations 1 to 6 are described in more detail in the remaining description.

The system for producing tubular concrete products in a casting method also comprises a curing zone B for storing a plurality of filled casting molds (not shown, see FIG. 4, for example) and a transport device 30 for transporting casting molds from a mold releasing position P3 to storage positions in the curing zone B and of storage positions in the curing zone B to a mold feeding position P1.

The mold feeding position P1 here serves as a transfer position of casting molds from the curing zone B to the fabrication zone A, and the mold feeding position P1 here serves as a transfer position of casting molds from the fabrication zone A to the curing zone.

The curing zone B comprises a plurality of respectively connected subzones, here by way of example the subzones B1, B2 and B3. The plurality of casting molds stored in the curing zone B preferably has a plurality of groups of casting molds, wherein casting molds of one group have an equal mold size and casting molds of different groups have different mold sizes and wherein the casting molds stored in the curing zone B are arranged according to groups, and casting molds of one group are arranged in a connected common subzone of the curing zone B.

In the exemplary embodiment according to FIG. 1, there are by way of example three groups of casting molds, namely a first group of casting molds of a first mold size which are stored in such a way that they are arranged in groups in the first subzone B1, a second group of casting molds of a second mold size which are stored in such a way that they are arranged in groups in the second subzone B2, and third group of casting molds having a third mold size which are stored in such a way that they are arranged in groups in the third subzone B3. This makes is possible to store casting molds of several (here three by way of example) different dimensions in the curing zone at the same time.

Here, casting molds of different dimensions can simultaneously be in the circulation of the production system, and therefore the production of tubular concrete products of the most different size and optionally also shape in the same circulation cycle becomes possible without the requirement of assembly times or downtimes so as to achieve a considerable gain of efficiency and time.

The transport device 30 comprises by way of example a gripping device 30*c*, which is guided on a first guide device 30*b* that is guided on a second guide device 30*a* extending transversely thereto. The transport device 30 is adapted to move the gripping device 30*c* by means of the guide devices 30*a* and 30*b* in the area of curing zone B so as to be able to receive casting molds in the entire curing zone by means of the gripping device 30*c*, and to transport received casting molds in the area of curing zone B. In particular, the transport device 30 is adapted to receive a casting mold stored in curing zone B and transport it to the mold feeding position P1 and receive a casting mold arranged at the mold releasing position P3 and transport it to the corresponding storage position in the curing zone.

The fabrication zone A of the system has the following fabrication stations: a first demolding station 1 is established for removing an outer mold from a casting mold positioned at the first demolding station 1. A second demolding station 2 is established for removing a cured tubular concrete product from a mold core positioned at the second demolding station 2. A mold core cleaning station 3 is established for cleaning a mold core positioned at the mold core cleaning station 3. An outer mold cleaning station 4 is established for cleaning an outer mold positioned at the outer mold cleaning station 4. A mold assembly station 5 is established for assembling a casting mold from an outer mold and a mold core and a filling station 6 is established for filling an assembled casting mold with concrete.

Hence the fabrication zone has a production line of a circulation cycle, which comprises the operations of demolding the casting mold (first and second demolding stations 1 and 2), cleaning the casting mold (mold core cleaning station 3 and outer mold cleaning station 4), assembling or marrying the cleaned casting mold (mold assembly station 5) and filling with or casting in concrete (filling station 6) in a path-optimized arrangement.

For example, e.g. shrinkage cores can be used as mold cores which are shrunk at the second demolding station 2 to be able to remove the concrete product at the second demolding station 2. Furthermore, possible base sleeves can be fixedly attached to the mold cores and also be cleaned in the mold core cleaning station 3. The outer molds can be forced on the mold cores and be locked with possible base sleeves.

The fabrication stations 1 to 6 are adapted for carrying out the respective operations at the same time, and therefore five or more casting molds can simultaneously be found in the circulation cycle of the fabrication stations 1 to 6, e.g. a first casting mold at the first demolding station 1, a mold core of a second casting mold at the second demolding station 2, a mold core of a third casting mold at the mold core cleaning station 3, a fourth casting mold at the mold assembly station 5 and a fifth casting mold at the filling station 6.

Then, an outer mold of the second casting mold could then be located at the outer mold cleaning station 4 depending on the design of the conveyor 20, wherein the outer mold of the third casting mold would then be located at an intermediate position between the fabrication stations 4 and 5 or an outer mold of the third casting mold could be located at the outer mold cleaning station 4, wherein the outer mold of the second casting mold would then be located at an intermediate position between the fabrication stations 1 and 4. If further intermediate positions are provided, optionally even more than five casting molds can simultaneously be located in the circulation cycle of the fabrication stations 1 to 6.

The mold conveyor 20 is adapted to convey a filled casting mold from the mold feeding position P1 to the first demolding station 1, to convey an outer mold removed at the first demolding station 1 to the outer mold cleaning station 4, to convey a mold core having a cured tubular concrete product from the first demolding station 1 to the second demolding station 2, to convey a cured tubular concrete product removed at the second demolding station 2 to the product releasing position (P2) (to release the finished concrete product and optionally feed it to post-processing), to convey a mold core from the second demolding station 2 to the mold core cleaning station 3, to convey a mold core from the mold core cleaning station 3 to the mold assembly station 5, to convey an outer mold from the outer mold cleaning station 4 to the mold assembly station 5, to convey a casting mold assembled at the mold assembly station 5 to the filling station 6, and to convey a casting mold filled with concrete at the filling station 6 to the mold releasing position P3.

Here, the respective mold cores and outer molds of the casting molds according to this exemplary embodiment are conveyed between the demolding station 1 and the mold assembly station 5 in lines which are guided in production-technically parallel fashion and cleaned in separately provided cleaning stations 3 and/or 4. For this purpose, the mold conveyor 20 has the first mold conveying section 20*a* and the second mold conveying section 20*b* extending parallel to the first mold conveying section 20*a*, wherein the first mold conveying section 20*a* is adapted to convey a mold core from the second demolding station 2 to the mold core cleaning station 3 and to convey the mold core from the mold core cleaning station 3 to the mold assembly station 5, and wherein the second mold conveying section 20*b* is adapted to convey an outer mold removed at the first demolding station 1 to the outer mold cleaning station 4 and to convey an outer mold from the outer mold cleaning station 4 to the mold assembly station 5.

This enables in an advantageous way to reduce the cycle times of the system since the cleaning operations for mold core and outer mold can be carried out separately and independently from one another and in particular at the same time.

Furthermore, the system comprises a control device (not shown) for controlling the fully automated fabrication stations 1 to 6, the mold conveyor 20 and the transport device 30. Thus, all fabrication stations 1 to 6 and the mold conveyor 20 can be controlled in harmony with one another.

Here, the control device can be adapted to control the fabrication stations 1 to 6 in such a way that the operations at the fabrication stations 1 to 6 are carried out at the same time, and to control the conveyor 20 in such a way that casting molds, outer molds and/or mold cores are conveyed depending on a length of cycle after conducting the respective operations at the fabrication stations 1 to 6 to the respectively next fabrications stations 1 to 6 of the circulation cycle.

Second Exemplary Embodiment

Figure 2:
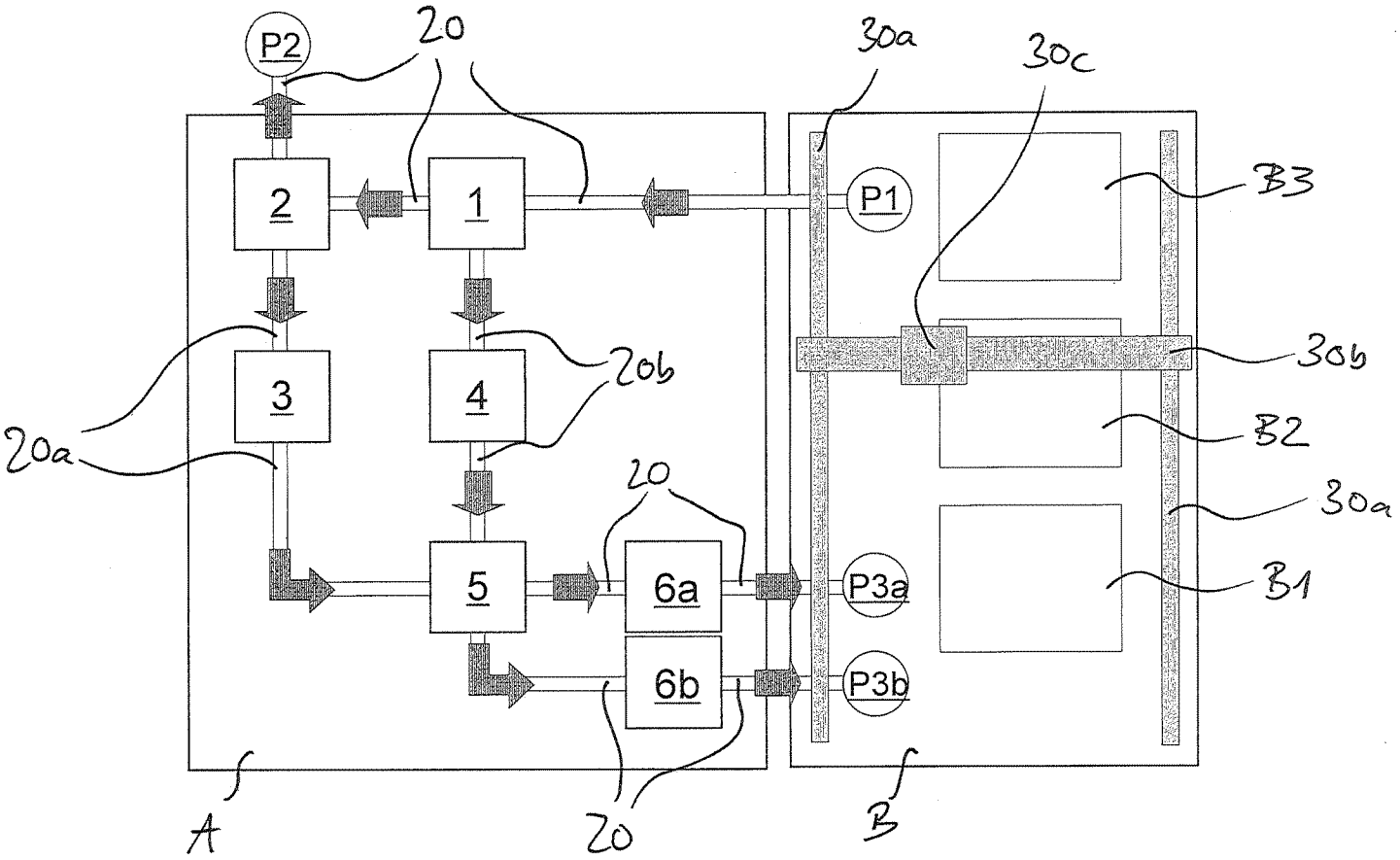
FIG. 2 shows a schematic top view of a system for producing tubular concrete products in a casting method by means of upright casting molds according to a second exemplary embodiment of the invention.

FIG. 2 shows a schematic top view of a system for producing tubular concrete products in a casting method by means of upright casting molds according to a second exemplary embodiment of the invention.

Here, the system of the second exemplary embodiment differs from that of the first exemplary embodiment in that along with the first filling station 6*a* a further filling station 6*b* is provided. The conveyor 20 in the second exemplary embodiment is adapted to convey a casting mold assembled at the mold assembly station 5 to the first filling station 6*a*, e.g. if a casting mold is already filled at the second filling station 6*b*, or to convey it to the second filling station 6*b*, e.g. if a casting mold is already filled at the first filling station 6*a*.

This enables in an advantageous way to reduce the lengths of cycle of the system since the time-consuming operations of filling the casting mold with concrete can be carried out in parallel at two (or in other exemplary embodiment optionally also three or more) filling stations provided separately side by side.

The conveyor 20 of the second exemplary embodiment is adapted to convey a casting mold filled with concrete at the first filling station 6*a* to a first mold releasing position P3*a* and to convey a casting mold filled with concrete at the second filling station 6*b* to a second mold releasing position P3*b*. Correspondingly, the transport device 30 is adapted to receive a casting mold arranged at the first mold releasing position P3*a* and to receive a casting mold arranged at the second mold releasing position P3*b*. In alternative exemplary embodiments, the conveyor 20 can also be adapted to convey casting molds from the two filling stations 6*a* and 6*b* to the same mold releasing position.

Third Exemplary Embodiment

Figure 3:
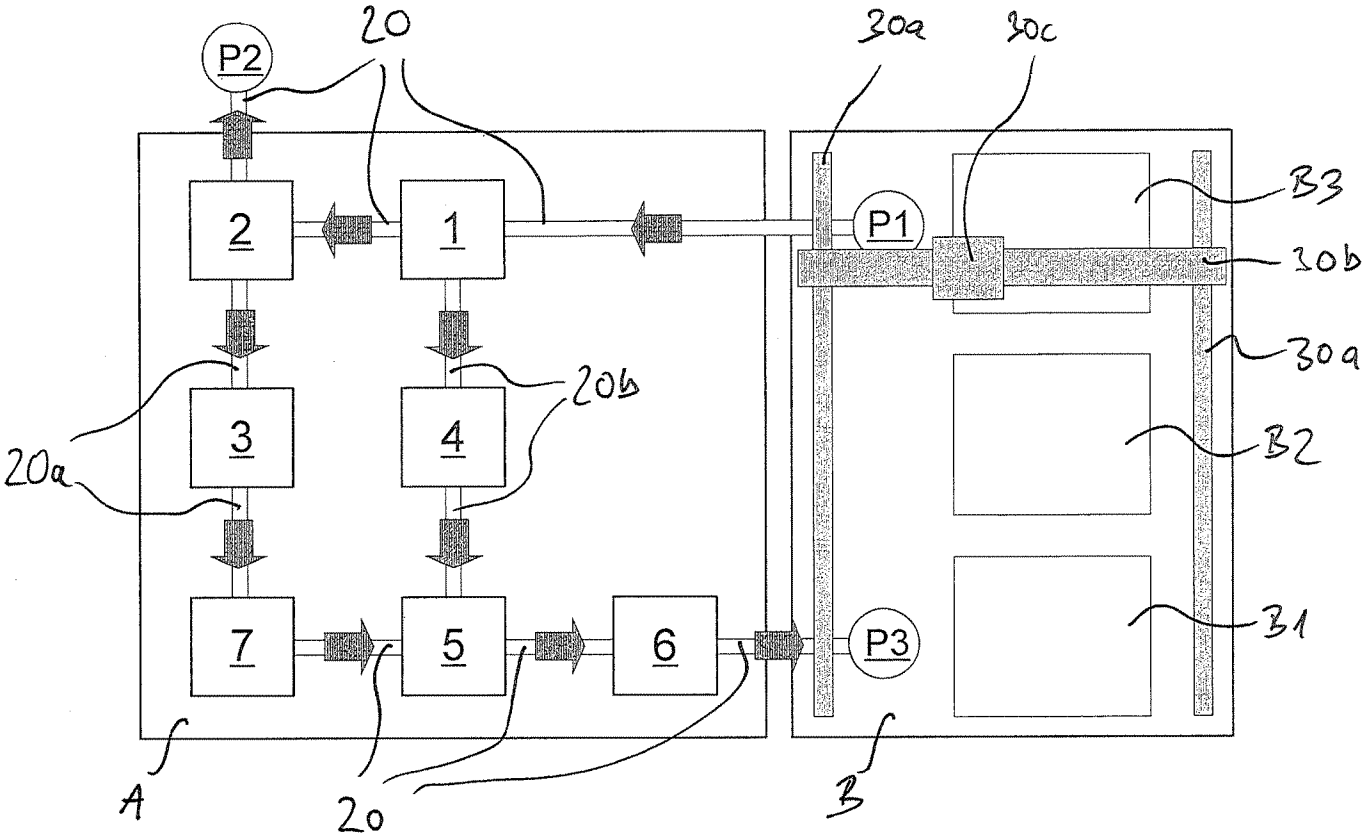
FIG. 3 shows a schematic top view of a system for producing tubular concrete products in a casting method by means of upright casting molds according to a third exemplary embodiment of the invention.

FIG. 3 shows a schematic top view of a system for producing tubular concrete products in a casting method by means of upright casting molds according to a third exemplary embodiment of the invention. Here, the system of the third exemplary embodiment differs from that of the first exemplary embodiment in that another optional fabrication station 7 is provided between the mold core cleaning station 3 and the mold assembly station 5.

For example, it is conceivable to provide at the site of the fabrication station 7 a coating station which is adapted to externally coat a mold core arranged at the coating station after the cleaning, e.g. by means of a separating agent, such as wax, or by means of a separating agent containing fat, such as oil, which could be applied to the mold core by spraying or by sponge application, for example. A similar coating station could be provided in other exemplary embodiments in addition or alternatively for the outer molds in the production line of the mold conveying section 20*b* behind the outer mold cleaning station 4 to coat the outer mold on the inside.

Furthermore, it would be conceivable to provide, alternatively or additionally to a coating station, the site of the fabrication station 7 with one (or more) mounting station(s) where it is possible to mount gaskets and/or other insertion parts on the mold core arranged at the fabrication station 7. One (or more) similar mounting station(s) could be provided in other exemplary embodiments additionally or alternatively also for the outer molds in the production line of the mold conveying section 20*b* behind the outer mold cleaning station 4.

Furthermore, it would e.g. be conceivable to provide, alternatively or additionally to a coating station or mounting station, the site of the fabrication station 7 with one or more insertion stations to attach reinforcements, such as reinforcement rings or reinforcement cages, to the mold core arranged at the fabrication station 7 or to also apply thin-walled inner tubes (e.g. from plastic material, what is called inliners) to the mold core arranged at the fabrication station 7.

Fourth Exemplary Embodiment

Figure 4:
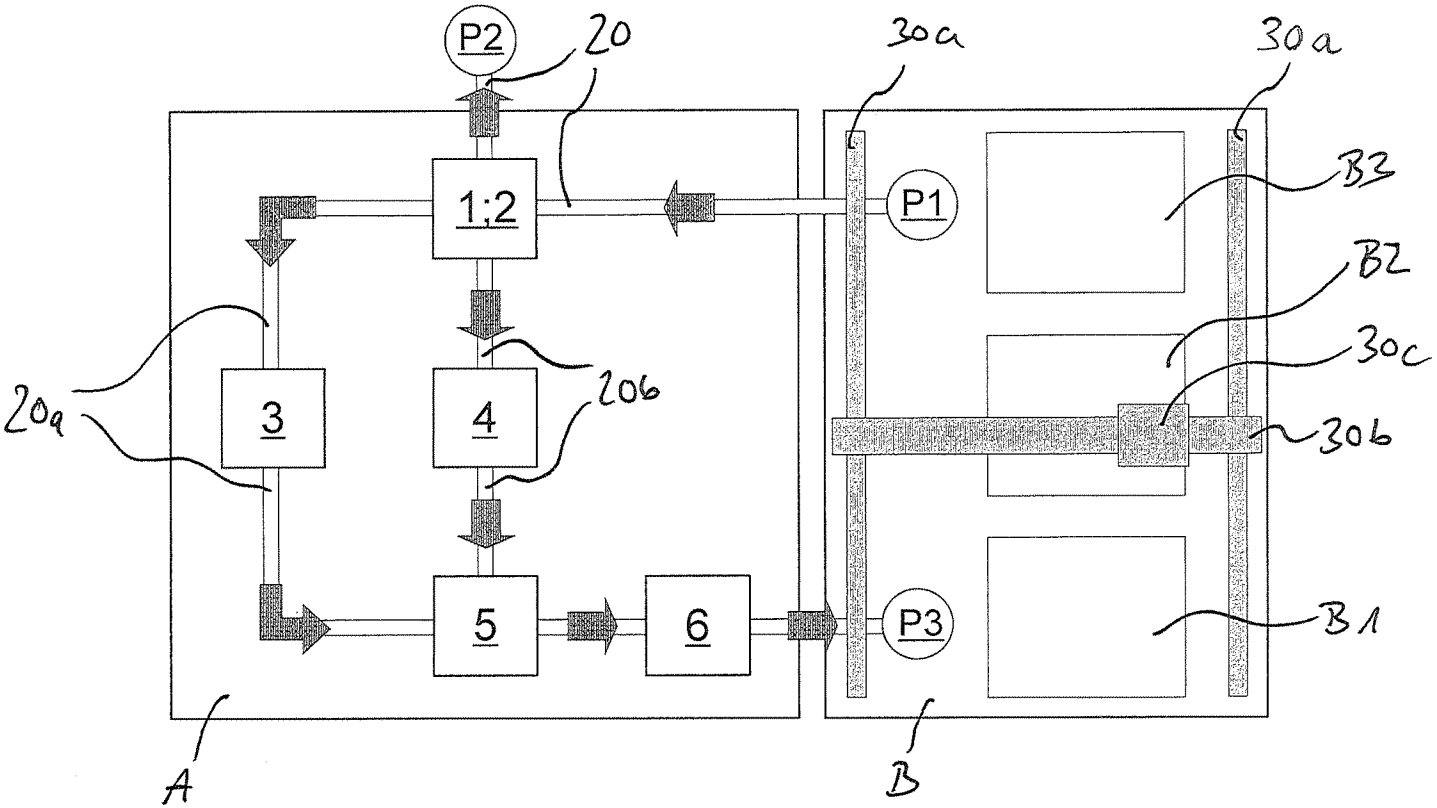
FIG. 4 shows a schematic top view of a system for producing tubular concrete products in a casting method by means of upright casting molds according to a fourth exemplary embodiment of the invention.

FIG. 4 shows a schematic top view of a system for producing tubular concrete products in a casting method by means of upright casting molds according to a fourth exemplary embodiment of the invention.

Here, the system of the fourth exemplary embodiment differs from that of the first exemplary embodiment in that the first demolding station 1 and the second demolding station 2 are combined by way of example in a fabrication station or are realized at a single fabrication station. Thus, the exemplary embodiment according to FIG. 4 omits the conveying section for conveying the mold core with the concrete product from the first demolding station to the second demolding station.

Therefore, it is possible to realize a first demolding station 1 for removing an outer mold from a casting mold positioned at the first demolding station 1 and a second demolding station 2 for removing a cured tubular concrete product from a mold core positioned at the second demolding station 2 at a single fabrication station.

In analogy, it is also possible to combine the first and second demolding stations 1 and 2 of the exemplary embodiments according to FIGS. 2 and 3.

Fifth Exemplary Embodiment

Figure 5:
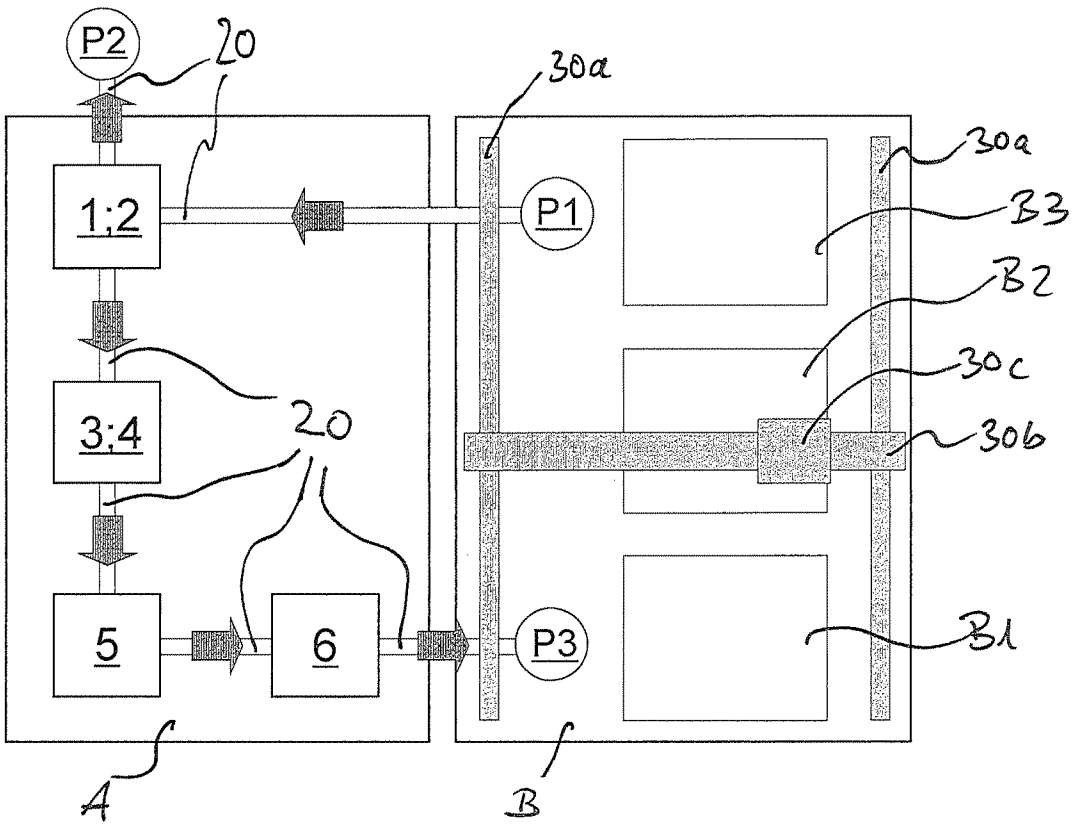
FIG. 5 shows a schematic top view of a system for producing tubular concrete products in a casting method by means of upright casting molds according to a fifth exemplary embodiment of the invention.

FIG. 5 shows a schematic top view of a system for producing tubular concrete products in a casting method by means of upright casting molds according to a fifth exemplary embodiment of the invention.

Here, the system of the fifth exemplary embodiment differs from that of the fourth exemplary embodiment in that the mold core cleaning station 3 and the outer mold cleaning station 4 are also combined by way of example in a single cleaning station or are realized at a single cleaning station. Thus the separate parallel guide by means of the conveying sections 20*a* and 20*b* is omitted in the exemplary embodiment according to FIG. 5.

Nevertheless, the mold cores and outer molds can optionally be conveyed in such a way that they are separate from one another, e.g. by conveying the mold core in a first lower plane and by conveying the outer mold in a second upper plane, as described below in the seventh exemplary embodiment, for example.

In analogy, the cleaning stations 3 and 4 of the exemplary embodiments according to FIGS. 2 and 3 can also be combined.

Sixth Exemplary Embodiment

Figure 6:
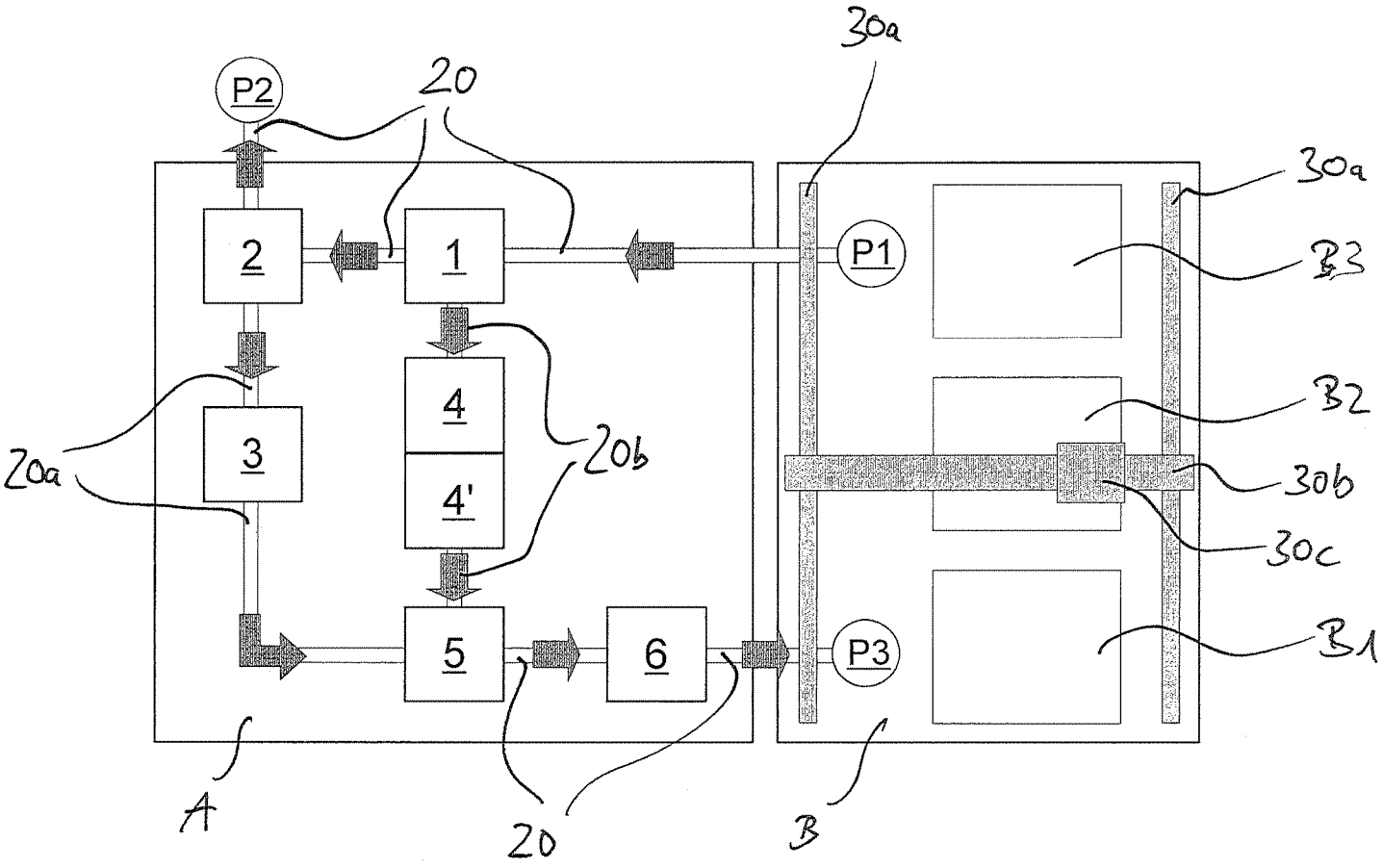
FIG. 6 shows a schematic top view of a system for producing tubular concrete products in a casting method by means of upright casting molds according to a sixth exemplary embodiment of the invention.

FIG. 6 shows a schematic top view of a system for producing tubular concrete products in a casting method by means of upright casting molds according to a sixth exemplary embodiment of the invention.

In connection with the exemplary embodiments according to FIGS. 4 and 5 it was described how cleaning stations and/or demolding stations, which are separate in the exemplary embodiments according to FIGS. 1 and 3, can be combined in a single common fabrication station or can be realized in one fabrication station.

On the other hand, it is also conceivable to divide individual or several fabrication stations of the exemplary embodiments according to FIGS. 1 to 3 sequentially in several fabrication stations disposed one behind the other.

In the exemplary embodiment according to FIG. 6, the outer mold cleaning station is here divided by way of example in two outer mold cleaning stations 4 an d 4' which are located sequentially one behind the other. Here, the outer mold cleaning stations 4 and 4' can be adapted in such a way that an outer mold is partly cleaned at the first outer mold cleaning station 4 and fully cleaned at the second outer mold cleaning station 4'. However, the two outer mold cleaning stations 4 and 4' are preferably adapted to fully clean one outer mold each, and therefore two outer molds can be cleaned per cycle in the length of cycle, i.e. one outer mold at the outer mold cleaning station 4 and one outer mold at the outer mold cleaning station 4'.

Depending on the requirement and for optimizing the length of cycle, it is in principle possible to divide each of the fabrication stations 1 to 6 or 7 of the above exemplary embodiments sequentially in two or more stations located one behind the other.

Seventh Exemplary Embodiment

Figure 7:
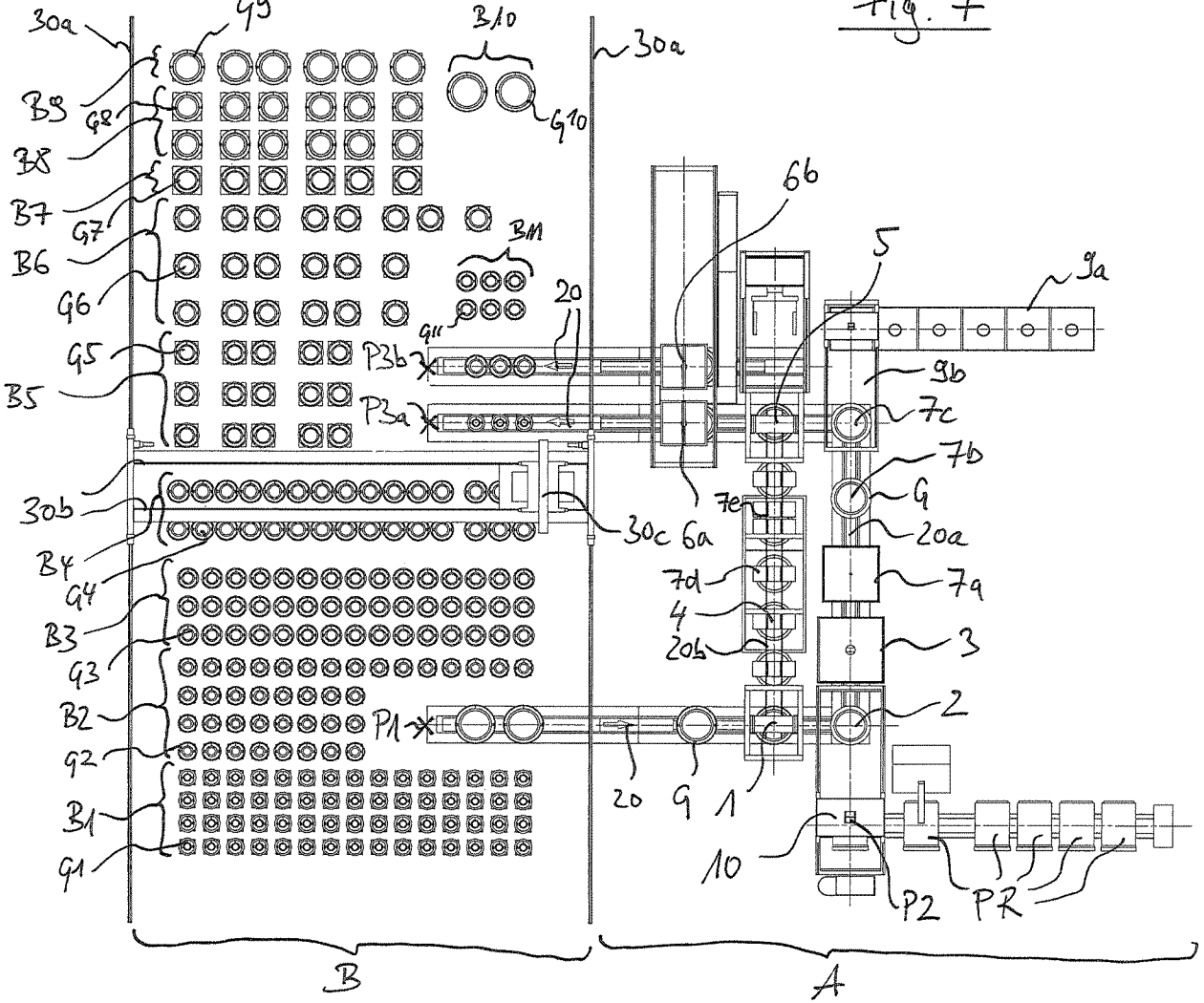
FIG. 7 shows a schematic top view of a system for producing tubular concrete products in a casting method by means of upright casting molds according to a seventh exemplary embodiment of the invention.
Figure 8:
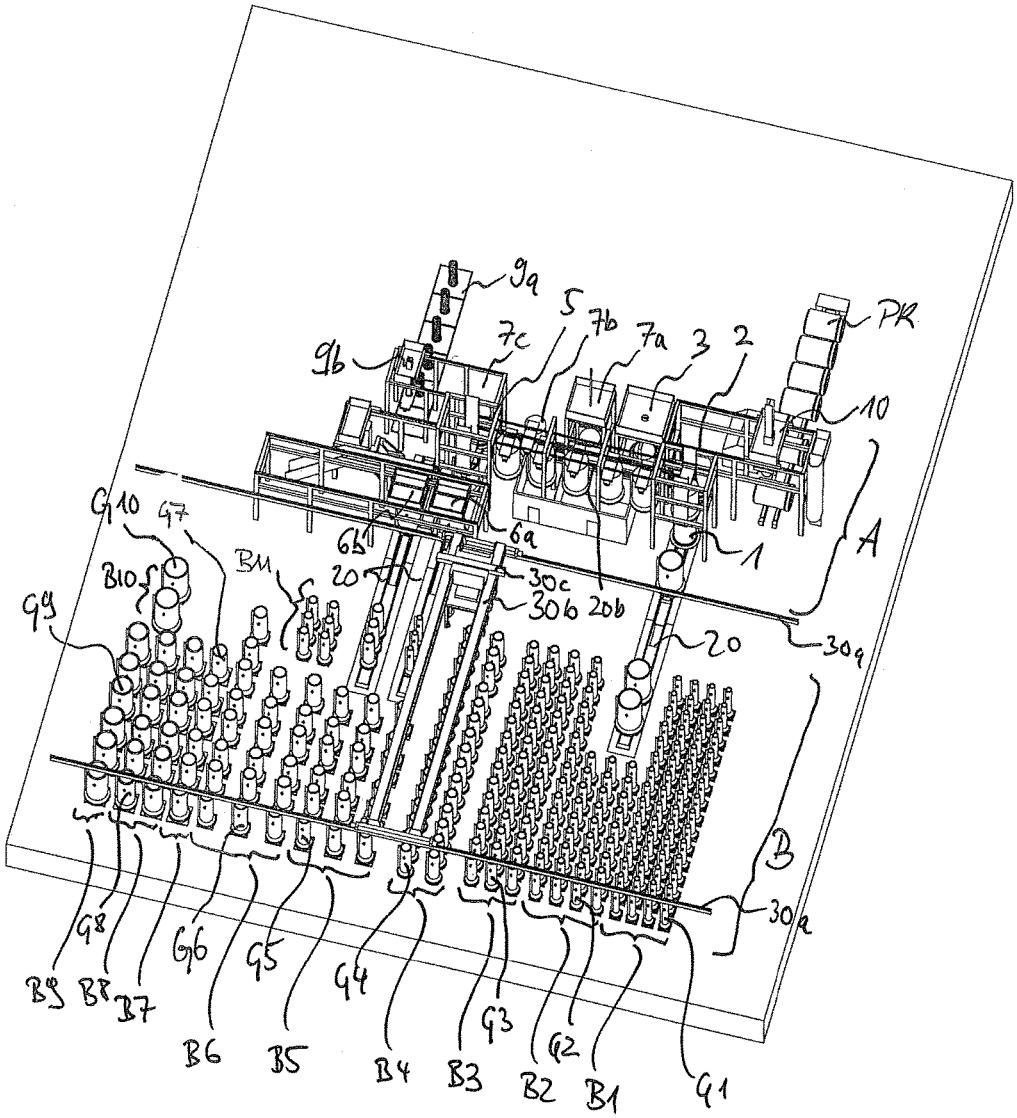
FIG. 8 shows a schematic perspective view of the system from FIG. 7.
Figure 9:
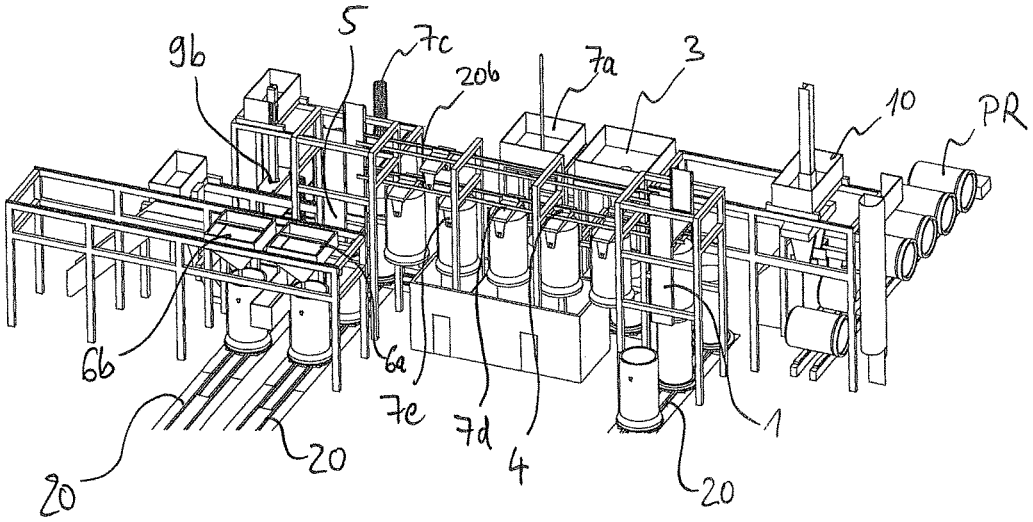
FIG. 9 shows a schematic perspective partial view of the fabrication zone of the system from FIG. 7.
Figure 10:
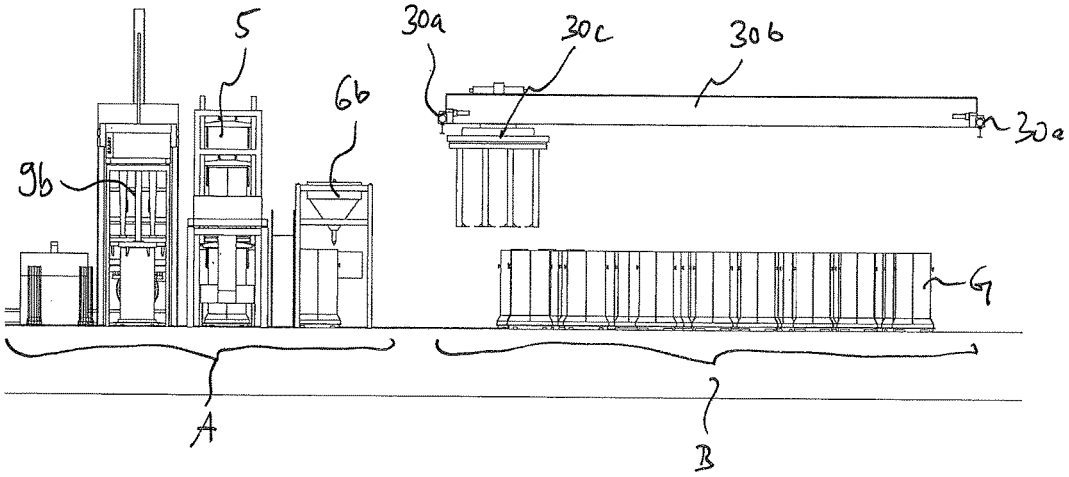
FIG. 10 shows a schematic front view of the system from FIG. 7.

FIG. 7 shows a schematic top view of a system for producing tubular concrete products in a casting method by means of upright casting molds according to a seventh exemplar embodiment of the invention. FIG. 8 shows a schematic perspective view of the system from FIG. 7. FIG. 9 shows a schematic perspective partial view of the fabrication zone of the system from FIG. 7. FIG. 10 shows a schematic front view of the system from FIG. 7.

In analogy to the system of the first exemplary embodiment, the system of the seventh exemplary embodiment has a fabrication zone A with fully automated fabrication stations and a mold conveyor 20 and a curing zone B having a transport orientation 30.

In analogy to the first exemplary embodiment, the fabrication stations comprise first and second demolding stations 1 and 2, a mold core cleaning station 3, an outer mold cleaning station 4 and a mold assembly station 5. In analogy to the system of the second exemplary embodiment, the system of the fourth exemplary embodiment has first and second mold filling stations 6*a* and 6*b*.

In analogy to the system of the third exemplary embodiment, the system of the fourth exemplary embodiment includes additional optional fabrication stations 7*a* to 7*e*. They include a mold core coating station 7*a*, a mounting station 7*b* and an insertion station 7*c* in the zone of the first mold conveying section 20*a* between the mold core cleaning station 3 and the mold assembly station 5.

The insertion station 7*c* is adapted by way of example to optionally attach reinforcement cages to the mold cores arranged at the insertion station 7*c*, as required, and reinforcement cages are supplied to the insertion station 7*c* via a reinforcement cage magazine 9*a* and a reinforcement cage handling device 9*b* in fully automated fashion, as required.

Furthermore, they include an outer mold coating station 7*d* and a second mounting station 7*e* in the zone of the second mold conveying section 20*b* between the outer mold cleaning station 4 and the mold assembly station 5.

A product handling device 10 is provided at the product output position P2 which is adapted to rotate a finished tubular concrete product PR arranged at the product output position P2 into a horizontal orientation and transfer it to a product conveyor 11.

A plurality of concrete products PR can be stored and conveyed on the product conveyor 11 to then be removed from the system. Concrete products PR can be post-processed (e.g. by milling) using an optional post-processing device 8. Alternatively or additionally, it is also possible to provide a checking station for the automatic check and quality management of the concrete products. Alternatively or additionally it is also possible to provide a pelleting device.

The curing zone B comprises a plurality of respectively connected subzones, here by way of example the subzones B1 to B11. The plurality of casting molds stored in the curing zone B preferably have, in analogy to the first exemplary embodiment, a plurality of groups of casting molds, wherein casting molds of one group have an equal mold size and casting molds of different groups have different mold sizes, and wherein the casting molds stored in the curing zone B are arranged in groups and casting molds of one group are arranged in a connected common subzone of the curing zone B.

In the exemplary embodiment according to FIG. 7, there would be by way of example 11 groups of casting molds G1 to G11 having eleven different mold sizes (here e.g. having different diameters), namely a first group of casting molds G1 of a first mold size which are stored in the first subzone B1 in such a way that they are arranged in groups, a second group of casting molds G2 having a second mold size which are stored in the second subzone B2 in such a way that they are arranged in groups, a third group of casting molds G3 having a third mold size which are stored in the third subzone B3 in such a way that they are arranged in groups and a fourth group of casting molds G4 having a fourth mold size which are arranged in the fourth subzone B4 in such a way that they are arranged in groups, etc. The same applies to the respective casting molds G5 to G11 in subzones B5 to B11.

It is thus possible to store casting molds (here e.g. three) of different dimensions at the same time in the curing zone. In this connection, casting molds of different dimensions can thus be located in the circulation of the production system at the same time so as to enable the production of tubular concrete products of different size and optionally shape in the same circulation cycle by advantageously avoiding assembly times or downtimes.

Figure 11:
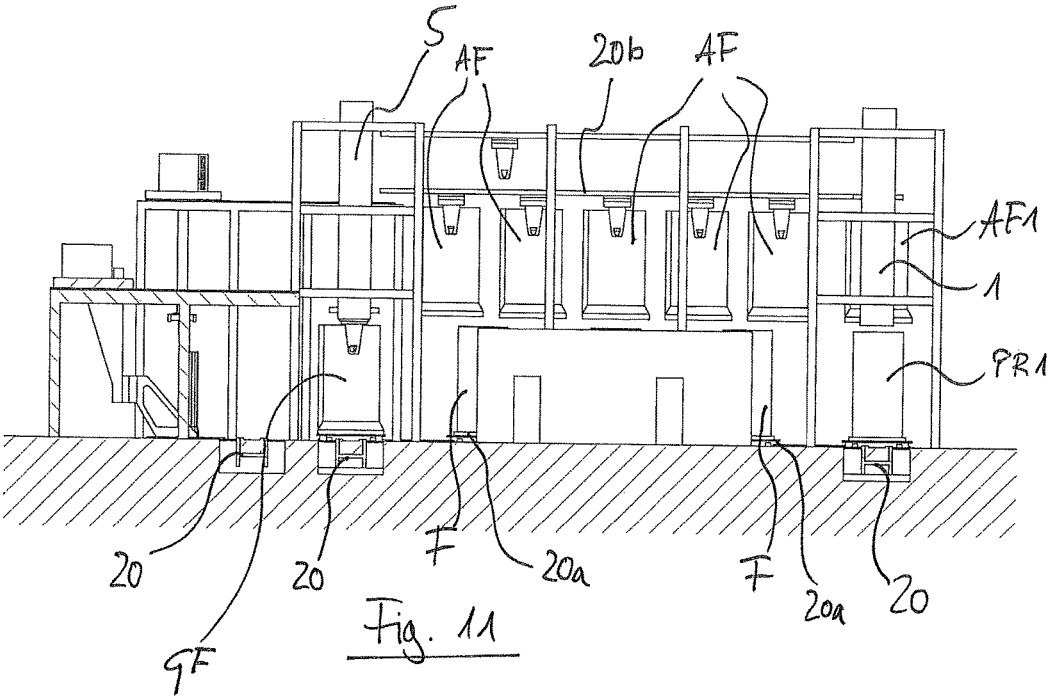
FIG. 11 shows a schematic sectional view of the fabrication zone of the system from FIG. 7 along intersection axis A-A.

FIG. 11 shows a schematic sectional view of the fabrication zone of the system from FIG. 7 along the intersection axis A-A. The first mold conveying section 20*a* is adapted to convey a mold core F in a first lower plane from the second demolding station 2 behind the first demolding station 1 in FIG. 11 to the mold assembly station 5, and the second mold conveying section 20*b* is adapted to convey an outer mold AF in a second upper plane from the first demolding station 1 to the mold assembly station 5. The second plane is arranged above the first plane. A cleaning operation at the outer mold cleaning station 4, a coating operation at the coating station 7*d* and a mounting operation at the mounting station 7*e* can thus be carried out advantageously on the outer molds AF from below.

The casting molds G and the mold cores F are always conveyed in the first plane, and the mold conveyor 20 is adapted to convey a filled casting mold G in the first plane from the mold feeding position P1 to the first demolding station 1, to convey a mold core F with a cured tubular concrete product in the first plane from the first demolding station 1 to the second demolding station 2, to convey a cured tubular concrete product PR removed at the second demolding station 2 in the first plane to the product output position P2, to convey a casting mold G assembled at the mold assembly station 5 in the first plane to the filling station 6, and to convey a casting mold G filled with concrete at the filling station 6 in the first plane to the mold releasing position P3.

The first demolding station 1 is here adapted by way of example to pull an outer mold AF1 from a concrete product PR1 on a mold core upwards into the second plane, optionally by means of opening a multi-part outer mold, and the mold assembly station 5 is adapted to force an outer mold for assembling the casting mold GF from the second plane into the first plane downwards over a mold core arranged at the mold assembly station 5. The outer molds AF are always conveyed in the second upper plane by means of the mold conveying portion 20*b* between the first demolding station 1 and the mold assembly station 5 (see also FIG. 9).

The above described exemplary embodiments should not be considered to be limiting with respect to themselves since it is possible to combine features of the above described exemplary embodiments of the present invention or to modify exemplar embodiments by features of other exemplary embodiments to obtain further exemplary embodiments of the present invention. In so far as such modifications or combinations of features come under the scope of the claims, they are to be regarded as part of the invention and in so far as evident to the person skilled in the art, such modifications or combination of features should furthermore be implicitly regarded as part of the disclosure of this description.

In the above described exemplary embodiments, the mold conveyor 20 can be made e.g. as a chain conveyor, however, the present invention is not limited to chain conveyors. The transport device 30 can be made as a robot crane.

The tubular concrete products produced by means of a system of the present invention can be produced in various models and shapes (optionally depending on provided optional fabrication stations and casting molds even without additional assembly times in a single circulation system). This comprises all shapes, sections and sizes of concrete tubes and tubes with and without reinforcements or inner tubes, e.g. made of plastic material.

In summary, the present invention enables to provide a system and a method where tubular concrete products can be produced at lower costs and with high quality and reliability in automated and efficient fashion in a casting method, and to provide in particular a system and a method where tubular concrete products of different dimensions can be produced with shorter lengths of cycle, without required assembly times and in particular short downtimes in automated and efficient fashion in a casting method.

The invention claimed is:

1. A system for producing tubular concrete products in a casting method using a plurality of upright casting molds, wherein each of the plurality of upright casting molds have an upright outer mold and a mold core arranged in the upright outer mold, the system configured to perform steps comprising:

a) at least one demolding station for removing the upright outer mold from one of the plurality of upright casting molds positioned at the at least one demolding station and for removing a cured tubular concrete product from the mold core of the one of the plurality of upright casting molds positioned at the at least one demolding station, b) at least one cleaning station for cleaning the mold core of the one of the plurality of upright casting molds positioned at the at least one cleaning station and for cleaning the upright outer mold of the one of the plurality of upright casting molds positioned at the at least one cleaning station, c) at least one mold assembly station for assembling another of the plurality of upright casting molds from the cleaned upright outer mold and the cleaned mold core, d) at least one filling station for filling the another of the plurality of assembled upright casting molds with concrete;

e) wherein a mold conveyor is configured to convey the another of the plurality of upright casting molds filled with concrete at the at least one filling station to a mold releasing position, f) wherein a transport device is configured to transport the another of the plurality of upright casting molds from the mold releasing position to a curing zone and from the curing zone to a mold feeding position, g) wherein the mold conveyor is further configured to convey the another of the plurality of filled upright casting molds from the mold feeding position to the at least one demolding station, h) repeating steps a through b for the another of the plurality of filled upright casting molds to form a further of the plurality of upright casting molds in step c;

i) repeating steps d through g for the further of the plurality of upright casting molds, wherein the curing zone is configured to store the plurality of filled upright casting molds;

and wherein the system further comprises a fabrication zone having a plurality of fully automated fabrication stations to convey the plurality of upright casting molds between the fabrication stations.

2. The system according to claim 1, wherein the mold conveyor is further configured:

to convey at least the upright outer mold of the one of the plurality of upright casting molds removed at the at least one demolding station to the at least one cleaning station, to convey the cured tubular concrete product removed at the at least one demolding station to a product releasing position, to convey at least the mold core of the one of the plurality of upright casting molds from the at least one demolding station to the at least one cleaning station, to convey at least the mold core of the one of the plurality of upright casting molds from the at least one cleaning station to the at least one mold assembly station, to convey at least the upright outer mold of the one of the plurality of upright casting molds from the at least one cleaning station to the at least one mold assembly station, and to convey at least the another of the plurality of upright casting molds assembled at the at least one mold assembly station to the at least one filling station.

3. The system according to claim 1, wherein the at least one demolding station comprising: a first demolding station for removing at least the upright outer mold of the one of the plurality of upright casting molds from the one of the plurality of upright casting molds positioned at the first demolding station, and a second demolding station for removing the cured tubular concrete product from at least the mold core of the one of the plurality of upright casting molds positioned at the second demolding station, wherein the mold conveyor is configured to convey the at least the mold core of the one of the plurality of upright casting molds with the cured tubular concrete product from the first demolding station to the second demolding station.

4. The system according to claim 1, wherein the at least one cleaning station comprising: a mold core cleaning station configured to clean at least the mold core of the one of the plurality of upright casting molds positioned at the mold core cleaning station, and an outer mold cleaning station configured to clean at least the upright outer mold of the one of the plurality of upright casting molds positioned at the outer mold cleaning station, wherein the mold conveyor is configured to convey the at least the mold core of the one of the plurality of upright casting molds from the mold core cleaning station to the at least one mold assembly station, and to convey the at least the upright outer mold of the one of the plurality of upright casting molds from the outer mold cleaning station to the at least one mold assembly station.

5. The system according to claim 3, wherein the at least one cleaning station comprising: a mold core cleaning station and an outer mold cleaning station, wherein the mold conveyor is configured to convey the at least the mold core of the one of the plurality of upright casting molds from the second demolding station to the mold core cleaning station and to convey the at least the upright outer mold of the one of the plurality of upright casting molds from the first demolding station to the outer mold cleaning station.

6. The system according to claim 3, wherein the at least one cleaning station comprising: a mold core cleaning station and an outer mold cleaning station, wherein the mold conveyor has a first mold conveying section and a second mold conveying section extending parallel to the first mold conveying section, wherein the first mold conveying section is configured to convey the at least the mold core of the one of the plurality of upright casting molds from the second demolding station to the mold core cleaning station and from the mold core cleaning station to the at least one mold assembly station, and wherein the second mold conveying section is configured to convey the at least the upright outer mold of the one of the plurality of upright casting molds removed at the first demolding station to the outer mold cleaning station and from the outer mold cleaning station to the at least one mold assembly station.

7. The system according to claim 6, wherein: the first mold conveying section is configured to convey the at least the mold core of the one of the plurality of upright casting molds in a first plane from the second demolding station to the at least one mold assembly station, and the second mold conveying section is configured to convey the at least the upright outer mold of the one of the plurality of upright casting molds in a second plane from the first demolding station to the at least one mold assembly station, wherein the second plane is arranged above the first plane.

8. The system according to claim 7, wherein: the first mold conveying section is configured to convey at least the another of the plurality of upright casting molds filled with concrete in the first plane from the mold feeding position to the first demolding station, so as:

to convey at least the mold core of the another of the plurality of upright casting molds having a cured tubular concrete product in the first plane from the first demolding station to the second demolding station, to convey the cured tubular concrete product removed at the second demolding station in the first plane to a product releasing position, to convey at least the further of the plurality of upright casting molds assembled at the at least one mold assembly station in the first plane to the at least one filling station, and from the filling station in the first plane to the mold releasing position.

9. The system according to claim 1, wherein: the plurality of filled upright casting molds stored in the curing zone comprises a plurality of groups of upright casting molds, wherein upright casting molds of one group have an equal mold size and upright casting molds of different groups have different mold sizes.

10. The system according to claim 1, comprising:

a control device configured to control the plurality of fully automated fabrication stations and the mold conveyor.

11. The system according to claim 10, wherein the control device is further configured to control the transport device.

12. The system according to claim 10, wherein the control device is configured to control the plurality of fully automated fabrication stations in such a way that the control operations can be carried out at the plurality of fully automated fabrication stations at the same time, and to control the mold conveyor in such a way that the plurality of upright casting molds, upright outer molds and/or mold cores are conveyed depending on a length of cycle after carrying out the respective control operations at the plurality of fully automated fabrication stations to the respectively next plurality of fully automated fabrication stations.

13. The system according to claim 10, wherein the control device is configured to control a concrete volume to be filled within at least the one of plurality of upright casting molds when the at least the one of plurality of upright casting molds is arranged at the at least one filling station is filled depending on a predetermined concrete product length.

14. The system according to claim 11, wherein the control device comprises a memory unit for storing production data which provides a respective storage position and a respective curing time for all upright casting molds stored in the curing zone.

15. The system according to claim 1, comprising:

at least one coating station for coating a cleaned upright outer mold and/or for coating a cleaned mold core.

* * * * *